US010767961B2

(12) United States Patent
Burianec et al.

(10) Patent No.: US 10,767,961 B2
(45) Date of Patent: Sep. 8, 2020

(54) OPTICAL SIGHT WITH A DEVICE FOR INDICATING A TURN OF A RECTIFIER AND WITH A ZERO STOP FUNCTION

(71) Applicant: Meopta—Optika, s.r.o., Prerov, Prerov I-Mesto (CZ)

(72) Inventors: Roman Burianec, Hranice I-Mesto (CZ); Jaroslav Struzka, Prerov I-Mesto (CZ); Antonin Zdrahala, Radotin (CZ)

(73) Assignee: Meopta-optika, s.r.o., Prerov, Prerov I-Mesto (CZ)

( * ) Notice: Subject to any disclaimer, the term of this patent is extended or adjusted under 35 U.S.C. 154(b) by 274 days.

(21) Appl. No.: 16/001,065

(22) Filed: Jun. 6, 2018

(65) Prior Publication Data

US 2018/0347945 A1 Dec. 6, 2018

(30) Foreign Application Priority Data

Jun. 6, 2017 (CZ) ..... 2017-322

(51) Int. Cl.

| | |
|---|---|
| ***F41G 1/38*** | (2006.01) |
| ***F41G 1/42*** | (2006.01) |
| ***F41G 1/40*** | (2006.01) |
| ***F41G 1/54*** | (2006.01) |

(52) U.S. Cl.

CPC ..... *F41G 1/38* (2013.01); *F41G 1/40* (2013.01); *F41G 1/42* (2013.01); *F41G 1/545* (2013.01)

(58) Field of Classification Search

CPC ..... F41G 1/38; F41G 1/42; G05G 1/10

See application file for complete search history.

(56) References Cited

U.S. PATENT DOCUMENTS

| | | | | |
|---|---|---|---|---|
| 7,612,952 | B2 * | 11/2009 | Schafer | F41G 1/38 359/813 |
| 8,312,667 | B2 | 11/2012 | Thomas et al. | |
| 8,516,736 | B2 | 8/2013 | Windauer | |
| 10,443,979 | B2 * | 10/2019 | Sheets, Jr. | F41G 1/38 |
| 2003/0140545 | A1 | 7/2003 | Huber | |
| 2008/0236018 | A1 | 10/2008 | Halverson | |
| 2017/0254624 | A1 * | 9/2017 | Geller | F41G 1/18 |
| 2018/0010887 | A1 * | 1/2018 | VanBecelaere | F41G 1/38 |
| 2018/0120059 | A1 * | 5/2018 | White | G02B 23/16 |
| 2019/0072363 | A1 * | 3/2019 | Kilic | F41G 1/38 |

* cited by examiner

*Primary Examiner* — Gabriel J. Klein
(74) *Attorney, Agent, or Firm* — Dority & Manning, P.A.

(57) ABSTRACT

An optical sight with a rectifier and device for indicating turns of the rectifier includes a longitudinal body that houses sight elements coupled to the rectifier. The rectifier includes a rotatable control element and an indicator protruding from an upper surface of the rectifier. The indicator includes a longitudinal identification protrusion rotatable about an axis that is perpendicular to its length and parallel to an axis of rotation of the control element. A coding device is associated with the longitudinal identification protrusion and is mounted on the upper surface of the rectifier above an upper surface of the longitudinal identification protrusion, wherein a rotated position of the longitudinal identification protrusion relative to the coding device provides an indication to a user of the optical sight of turning of the rectifier. A zero stop mechanism is configured with the control element of the rectifier.

10 Claims, 6 Drawing Sheets

OPTICAL SIGHT WITH A DEVICE FOR INDICATING A TURN OF A RECTIFIER AND WITH A ZERO STOP FUNCTION

TECHNICAL FIELD

The invention relates to an optical sight with a device for indicating a turn of a rectifier with a built-in zero stop function. The optical sight includes a longitudinal body, in which are mounted elements of the sight coupled to at least one mechanism of the rectifier, which comprises a rotatable control element to be used by the sight user for manual control. The rectifier is equipped with an indicator of the turn of the rectifier, which protrudes from the upper surface of the rectifier and which is coupled to a mechanism for identifying the rectifier turn.

BACKGROUND

In optical sights, such as optical sights used on rifles, etc., mechanisms are used that allow to correct the settings of the optical sight. In general, these mechanisms are called rectifiers.

The mechanism of a rectifier is integrated into a body of an optical sight and is connected to the element or system of elements of the optical sight which is being set. The mechanism of the rectifier is manually operated by means of a rotatable element mounted on the body of the sight. Some elements of the sight require a wider or finer range of setting, or it is the users of such sights that require a larger or finer range of setting. In order to meet this requirement, the entire working range of the element of the sight being set is controlled within two turns of the rotatable element of the rectifier, i.e. within the rotation range greater than 360°. To avoid mistakes of the user caused by not knowing whether he or she is moving during the setting of the rectifier within the first turn of the rectifier (or its control element) or within the second turn of the rectifier, these rectifiers are provided with a so-called rectifier turn indicator. The rectifier turn indicator is a mechanism that is coupled to the rotatable element of the rectifier or the rectifier mechanism, and when the rectifier moves from the first turn to the second turn, it provides information (visual, tactile) that makes it possible to readily detect this transition of the rectifier from first to second turn and back.

Well-known solutions of sights with rectifier turn indicators can be divided into two groups, whereby one group allows purely visual control of the rectifier turn, while the other group allows combined representation of the rectifier turn in the form of visual and tactile check. Using a tactile check is important especially in difficult visual conditions, such as at night and in situations when, for example, the user cannot use light to check the turn indicator because he or she does not want to reveal his or her presence or position, etc.

There are numerous well-known solutions that allow combined representation of the rectifier turn, for example the solutions known from US 2008/0236018, U.S. Pat. Nos. 7,612,952, 8,516,736, 8,312,667 and US 2003/0140545. One of the best-known solutions is the solution in which during the transition between the first and second turn of the rectifier, axial or radial extension (or insertion) of an identifying means (identifier) occurs, e.g. in the form of a pin or pins, or an axial extension of a ring into an annulus, another option being mutual rotation of the rings, etc.

Moreover, the mechanism of the rectifier is usually combined with the so-called "zero stop" function, which enables to set and lock the zero position of the rectifier according to the user's current needs, so that if the need arises to reset the rectifier completely, the user can return the rectifier easily, comfortably and reliably to this zero position, from which a new setting of the rectifier will start.

A common disadvantage of the solutions of the background art is a relatively complicated construction, which, in addition, generally requires the transfer of the rotary motion of the rectifier control element to the linear reciprocating motion of the rectifier turn identification element (identifier) being ejected and inserted.

The aim of the invention is therefore to eliminate or at least to reduce the drawbacks of the background art.

SUMMARY

Objects and advantages of the invention will be set forth in part in the following description, or may be obvious from the description, or may be learned through practice of the invention.

An aim is achieved by an optical sight with a device for indicating a turn of a rectifier with a built-in zero stop function, whose principle consists in that the indicator comprises a longitudinal identification protrusion, which is by its length located in a direction along the upper surface of the rectifier and which is rotatable about the axis OI, which is perpendicular to the length of the longitudinal identification protrusion and at the same time parallel to the axis of rotation of the rectifier control element. The longitudinal identification protrusion is rotatable about the axis OI between its basic position and its turned position and is associated with a coding means, which is mounted on the upper surface of the rectifier and is located above the upper surface of the longitudinal identification protrusion.

The advantages of this solution include user-friendly identification of the current state of the rectifier control element, namely the indication of the rectifier turn, as well as simple design and realization of the zero stop function.

DESCRIPTION OF DRAWINGS

The invention is schematically represented in the drawings, wherein.

DETAILED DESCRIPTION

Figure 1A:
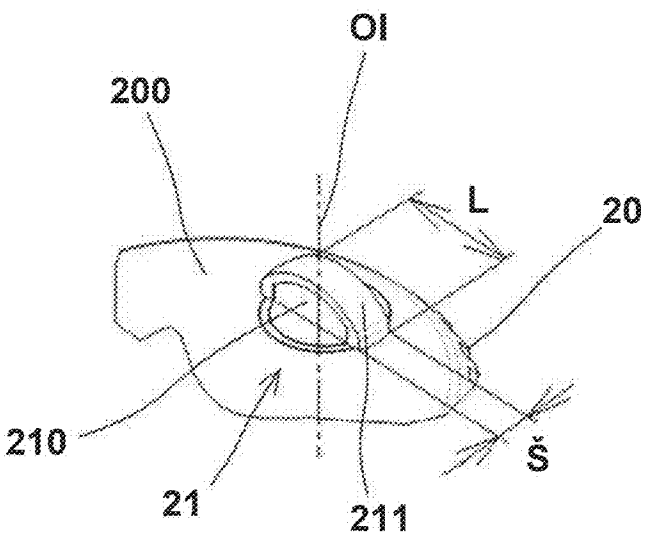
FIG. 1*a* is a detailed view of FIG. 1.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The invention will be described with reference to an exemplary embodiment of an optical sight with a device for indicating a turn of a rectifier with a built-in zero stop function, the optical sight comprising a longitudinal body 1, in which individual unillustrated elements of the sight are mounted.

The elements of the sight which can be set by the user when using the sight are coupled to mechanisms of rectifiers 2, which are mounted on the body 1. The rectifiers 2 comprise rotatable control elements 20, which are adapted to be used by the sight user for manual control.

At least one of the rectifiers 2 is provided with an indicator 21 of a turn of the rectifier 2, which protrudes from the upper surface 200 of the respective rectifier 2. The upper surface 200 of the respective rectifier 2 is either a part of the control element 20, turning together with it, or the upper surface 200 of the respective rectifier 2 is independent of the control element 20 and during the rotation of the control element 20 the upper surface 200 does not move.

The indicator 21 comprises a longitudinal identification protrusion 210, located by its length L in the direction along the upper surface 200 of the rectifier 2. The longitudinal identification protrusion 210 has a width S. The longitudinal identification protrusion 210 is rotatable about the axis OI, which is perpendicular to the length L of the longitudinal identification protrusion 210 and at the same time parallel to the axis OP of rotation of the control element 20 of the rectifier 2. For this rotatable movement, the longitudinal identification protrusion 210 is coupled to a mechanism for identifying the rectifier 2 turn, which will be described in more detail hereinafter.

Figure 1:
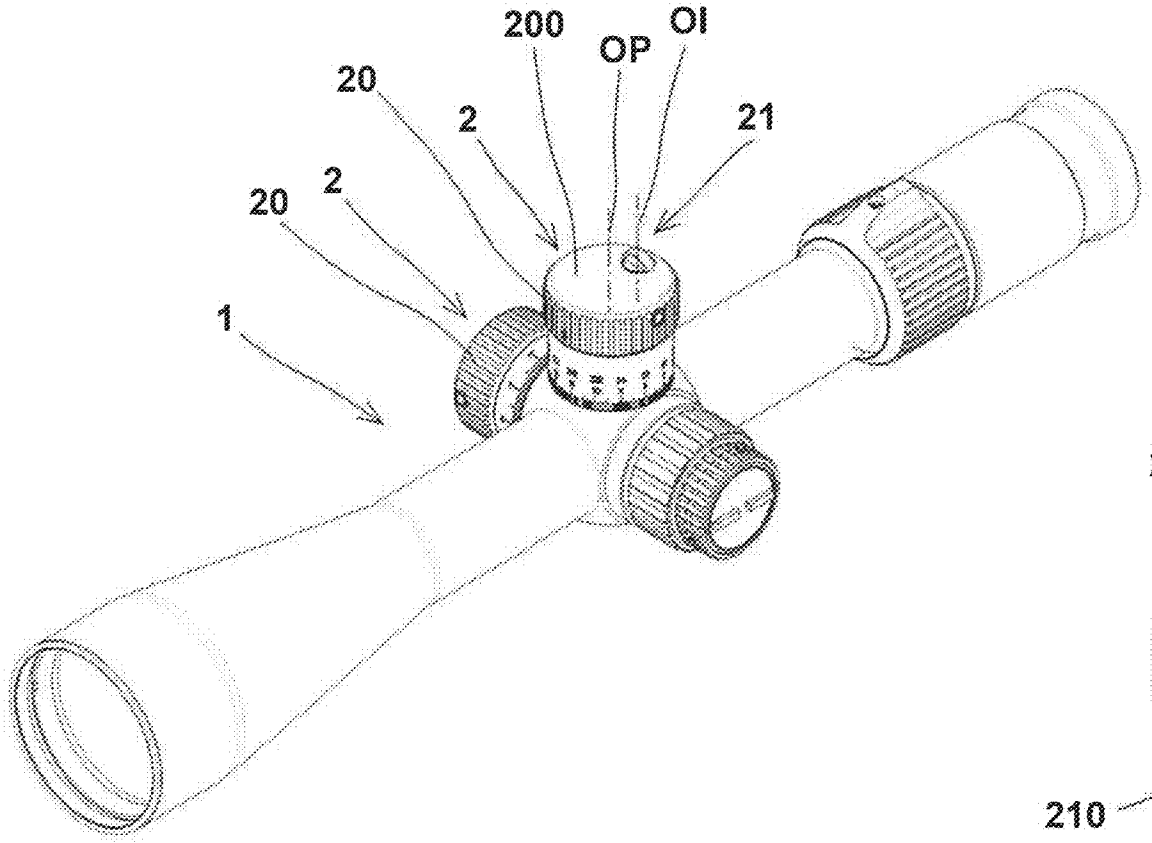
FIG. 1 shows an overall view of the sight according to the invention with a detail of the rectifier turn identifier in position 1.
Figure 2A:
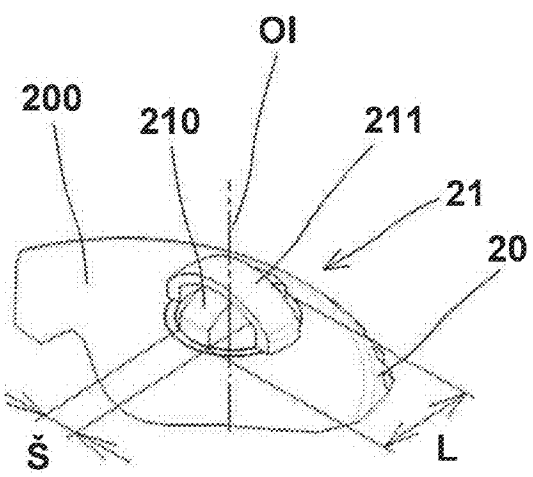
FIG. 2*a* is a detailed view of FIG. 2.
Figure 2:
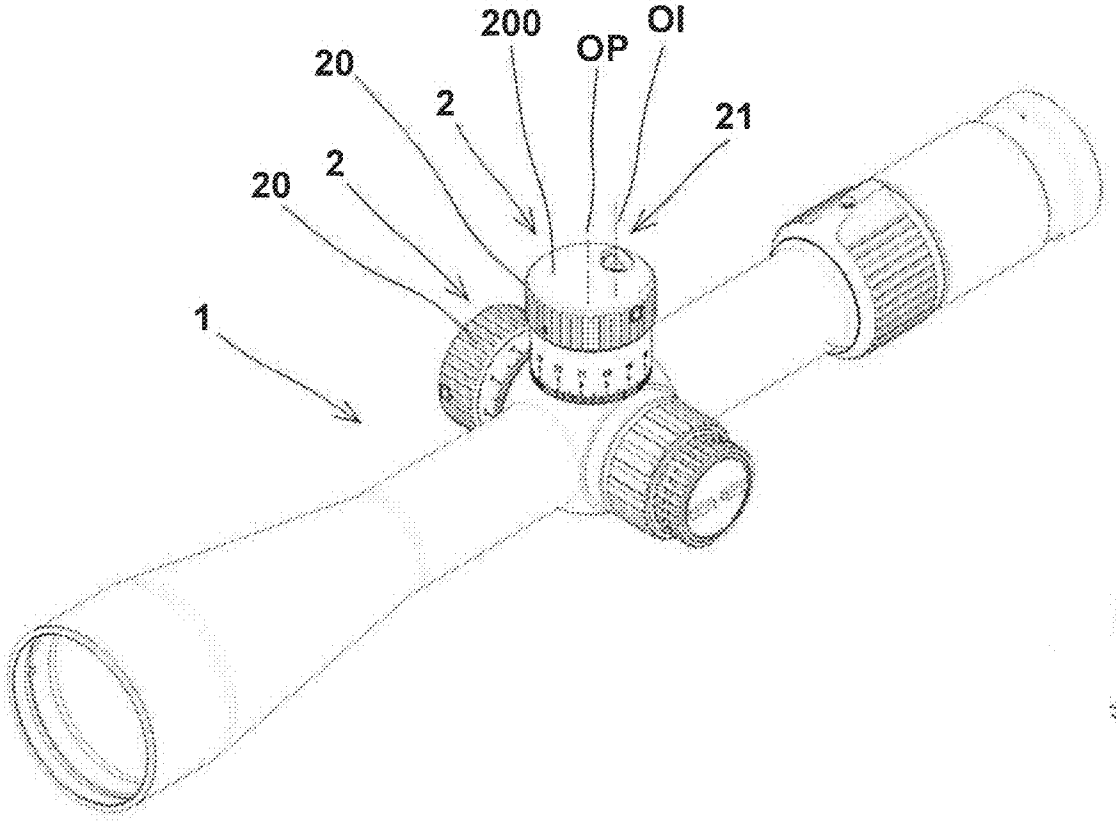
FIG. 2 is an overall view of the sight according to the invention with a detail of the rectifier turn identifier in position 2.

The longitudinal identification protrusion 210 is rotatable about the axis OI between its basic position, see FIGS. 1 and 1*a*, which indicates the first turn of the rectifier 2 and the turned position, see FIGS. 2 and 2*a*, which indicates the second turn of the rectifier 2, or indicates that the rectifier 2 is within its second turn. Preferably, the longitudinal identification protrusion 210 turns by 90° between its two positions, as is apparent from FIGS. 1, 1*a*, 2 and 2*a*. In another embodiment, the size of this turn is different, but it is necessary that the size of this turn of the longitudinal identification protrusion 210 fulfills its purpose of reliable identification of the rectifier 2 transition between the first and second turns in connection with the coding means 211 of the longitudinal identification protrusion 210, which will be described below, and in accordance with the logics of identification in cooperation with the coding means 211.

The above-mentioned coding means 211 of the longitudinal identification protrusion 210 is fixedly mounted on the upper surface 200 of the rectifier 2, whereby in the illustrated example is formed by at least one longitudinal strip. The coding means 211 is located at a level above the upper surface of the longitudinal identification protrusion 210, whereby in one turned position of the longitudinal identification protrusion 210, the coding means 211 is, for example, situated in the direction of the length L of the longitudinal identification protrusion 210, which it practically overlaps in the illustrated embodiment (see FIGS. 1 and 1*a*), while in another turned position of the longitudinal identification protrusion 210, the coding means 211 is, for example, situated transversely to the direction of the length L of the longitudinal identification protrusion 210 and substantially forms a cross with the longitudinal identification protrusion 210 (see FIGS. 2 and 2*a*). In principle, it is not important in which specific turned position the longitudinal identification protrusion 210 is situated along the coding means and in which it is situated across the coding means 211, or it is situated, for example, in another mutually defined position.

The coding means 211 is, for example, formed by a shaped strip of a suitable material which, by its bottom surface, follows the shape of the upper surface of the longitudinal identification protrusion 210. Alternatively, the width of the coding means 211, or, more specifically, of the strip by which it is formed, corresponds to the width S of the longitudinal identification protrusion 210, so that it would be possible to identify reliably—visually, but also tactilely—the mutual position of the longitudinal identification protrusion 210 and the coding means 211 and in this manner to determine accurately in which turn the rectifier 2 is currently. For easier visual control, the longitudinal identification protrusion 210 in the unillustrated embodiment is distinguished by its color from the coding means 211 and, if appropriate, also from the other elements of the rectifier 2.

The above-mentioned mechanism for identifying a turn of the rectifier 2, which ensures respective rotation of the longitudinal identification protrusion 210 depending on the current turn of the control element 20 of the rectifier 2, comprises a variation of a Maltese mechanism with a Maltese cross 3, whose rotatable motion, which is transferred onto the longitudinal identification protrusion 210, is evoked by a drive pin 4, and which is carried by the control element 20 of the rectifier 2.

Figure 10:
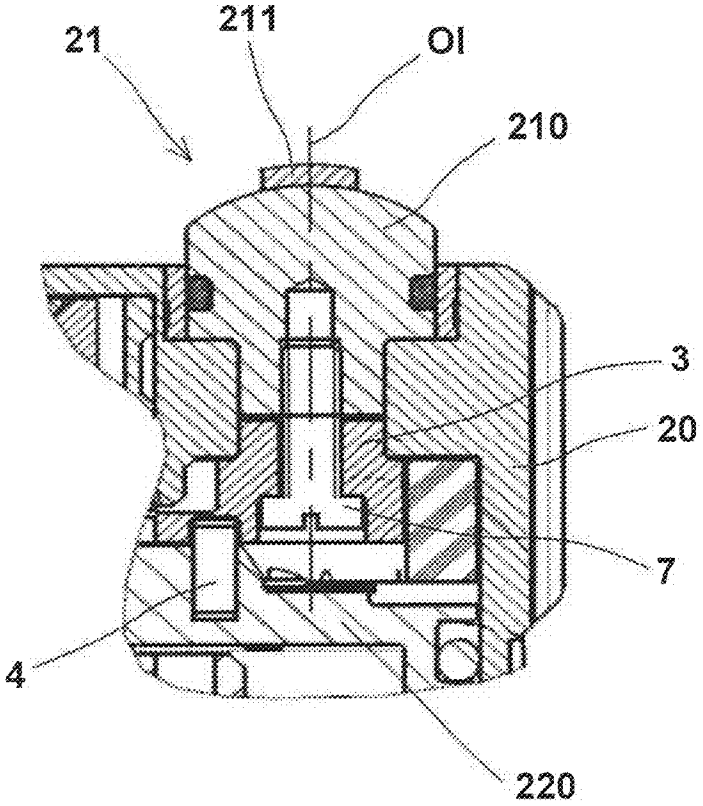
FIG. 10 shows an alternative embodiment of the connection of a quarter Maltese cross with the longitudinal identification protrusion by means of an axial pin on a shaft.

FIGS. 3 to 8 show an arrangement of the above-mentioned variant of the Maltese mechanism for transferring the rotatable motion of the control element 20 of the rectifier 2 onto the longitudinal identification protrusion 210. The Maltese cross 3 is rotatably mounted on the shaft 7, whereby the axis of rotation of the shaft 7 is identical to the axis of rotation OI of the longitudinal identification protrusion 210. The Maltese cross 3 is coupled to the longitudinal identification protrusion 210 by a pin 6, which is by one of its ends eccentrically mounted in the Maltese cross 3 and by its other end is eccentrically mounted in the longitudinal identification protrusion 210. The Maltese cross 3 is provided with three grooves 30, 31, 32, which are arranged with respect to one another at an angular spacing and which are designed to cooperate with the drive pin 4, which is carried by the control element 20 of the rectifier 2 in the direction of the arrow R and against this direction R. In the schematic representation of FIG. 10, the Maltese cross 3 is coupled to the longitudinal identification protrusion 210 by means of an axial pin on the shaft 7.

The function of the mechanism is as follows.

Figure 4:
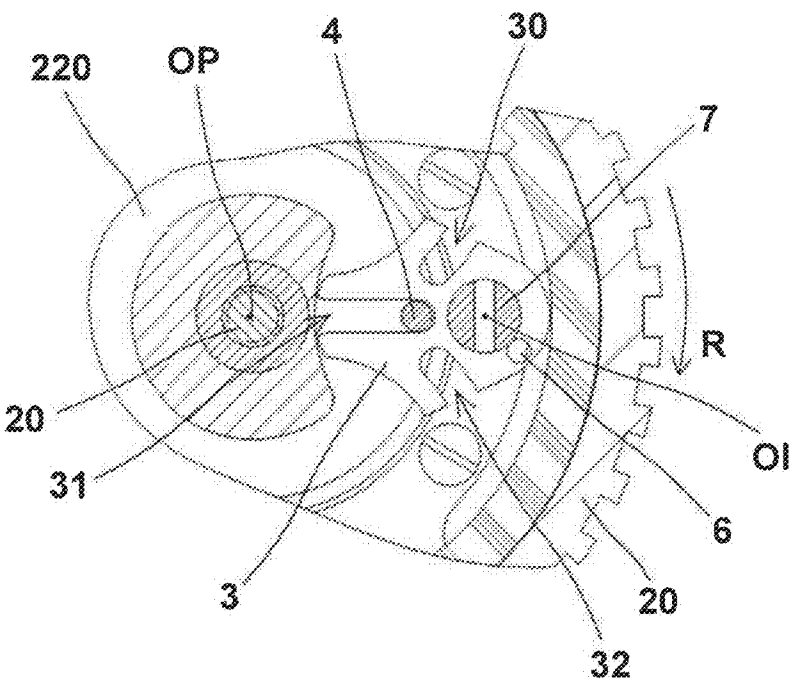
FIG. 4 shows a plan view of the arrangement of the positioning mechanism of the identifier in the middle position of the rectifier control element, i.e. during the transition from one turn to another.
Figure 3:
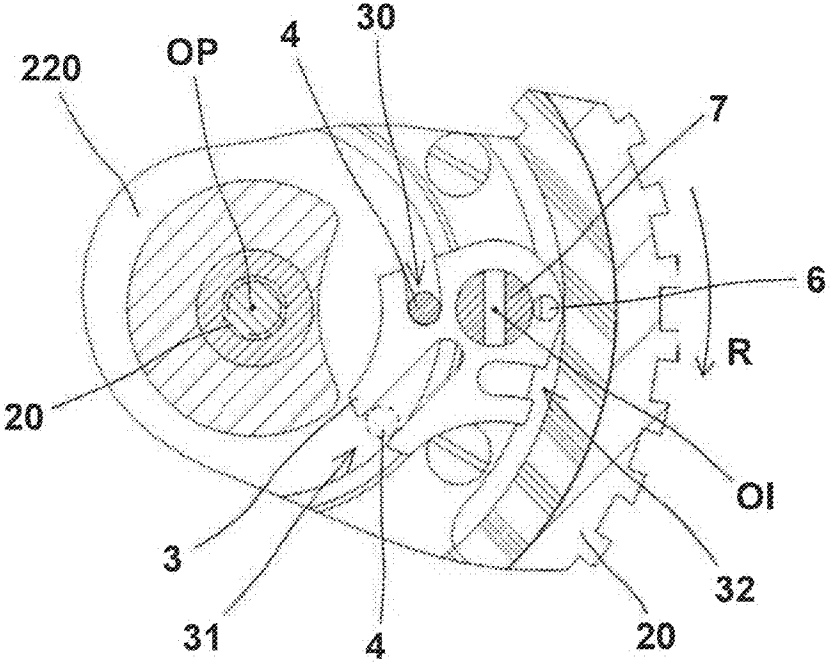
FIG. 3 is a plan view of the arrangement of the positioning mechanism of the identifier at top dead center of the rectifier control element (maximum turn of the rectifier control element)
Figure 6:
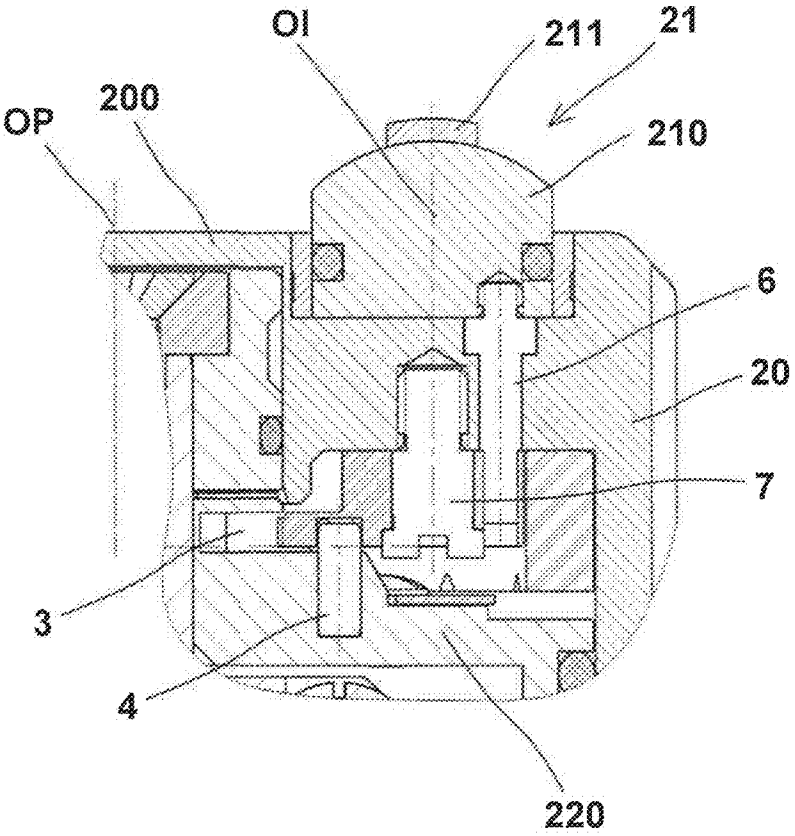
FIG. 6 is a cross-sectional view of the arrangement according to FIG. 3.
Figure 5:
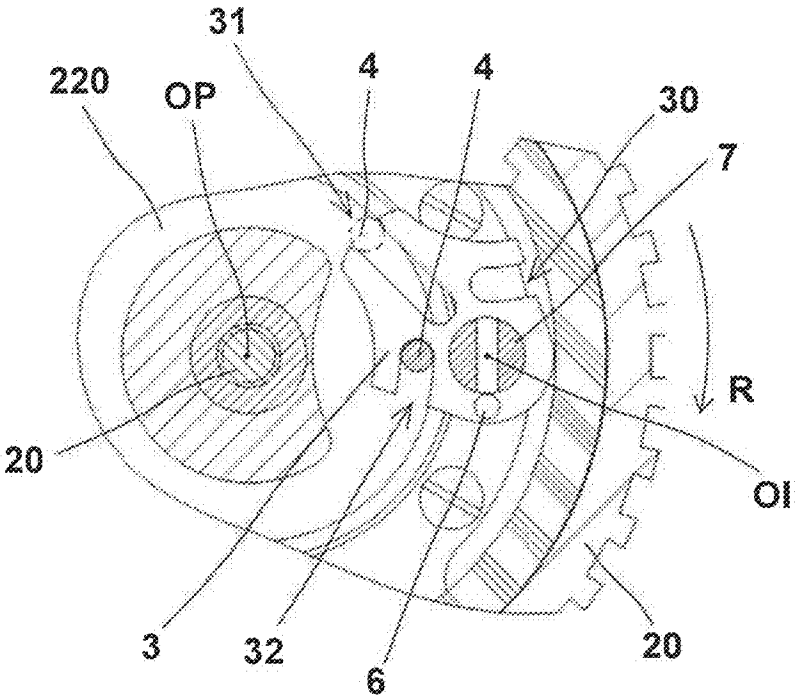
FIG. 5 shows is a plan view of the arrangement of the positioning mechanism of the identifier at bottom dead center (initial state) of the rotation of the rectifier control element (minimum turn-zero turn-turn of the rectifier control element-position for setting the "zero stop" function)
Figure 8:
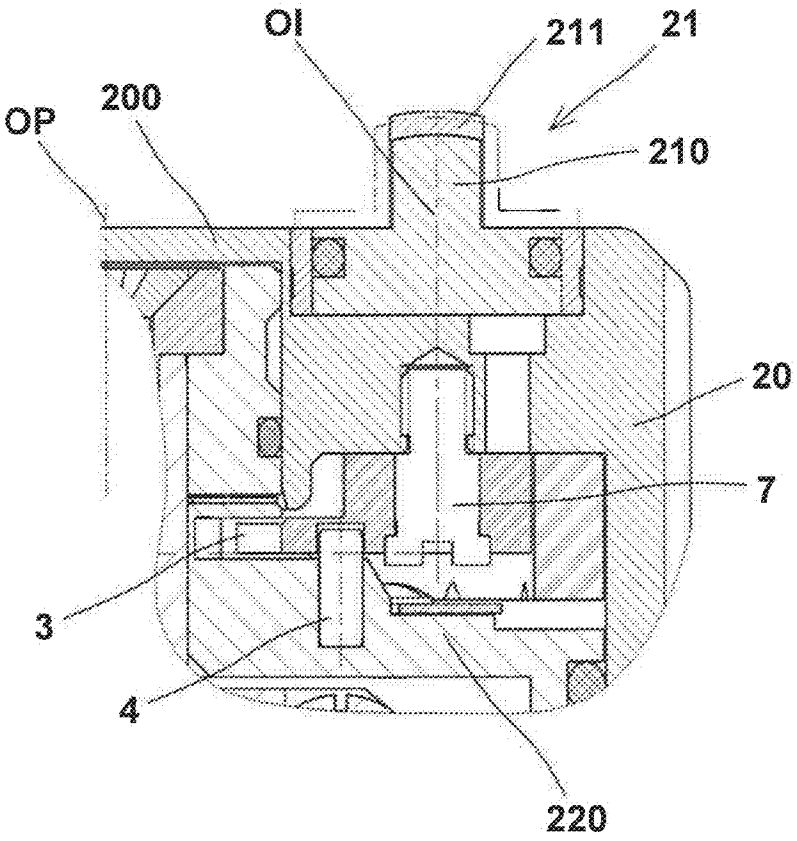
FIG. 8 is a cross-sectional view of the arrangement according to FIG. 5.
Figure 7:
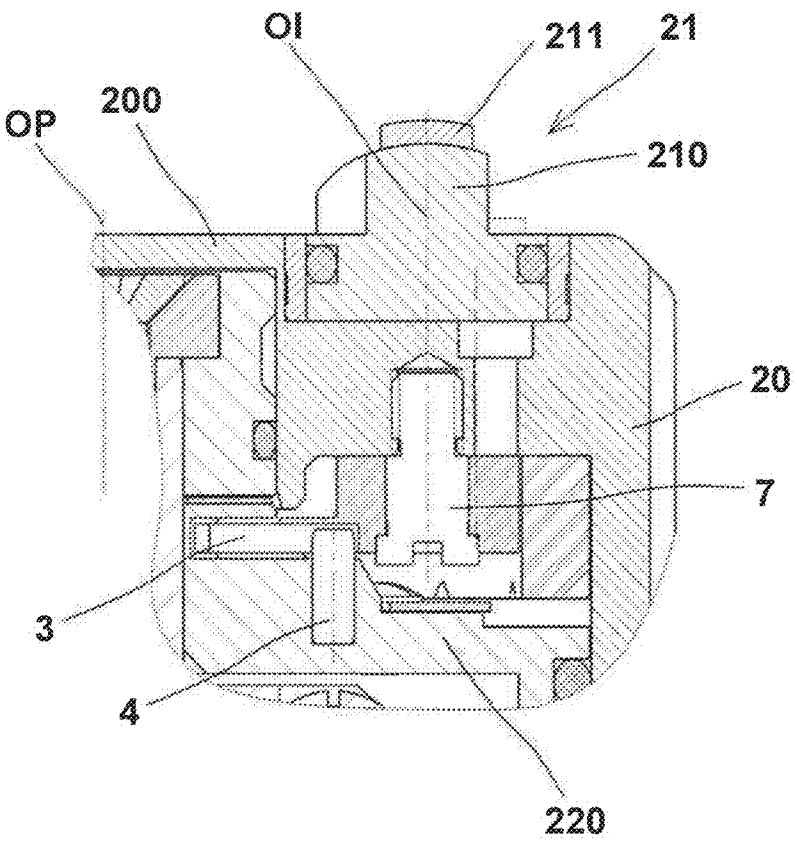
FIG. 7 is a cross-sectional view of the arrangement according to FIG. 4.

FIG. 3 and FIG. 6 show the rectifier 2 set in the uppermost position (at top dead center), i.e., in the illustrated embodiment at the beginning of the first turn of the rectifier 2. In this position, the drive pin 4, which is accommodated in the housing 220 of the rectifier 2, is engaged into the first groove 30 of the Maltese cross 3, which is rotatably mounted on the shaft 7. In addition, the axis of rotation of the shaft 7 is the same as the axis of rotation OI of the longitudinal identification protrusion 210 and the longitudinal identification protrusion 210 is located aligned with the coding means 211, see FIG. 1. Transferring the rotation of the Maltese cross 3 about the axis of rotation of the shaft 7 to the longitudinal identification protrusion 210 is secured by the pin 6, which is by one of its ends mounted in the Maltese cross 3 and by its other end it is mounted in the longitudinal identification protrusion 210, as shown in FIG. 6. When the control element 20 of the rectifier 2 is turning together with the Maltese cross 3 towards the so-called second turn of the rectifier 2 at first the Maltese cross 3 moves out of its position with the drive pin 4 in the first groove 30 of the Maltese cross 3 in the direction of the arrow R and before completing the first turn of the control element 20 of the rectifier 2 the middle groove 31 of the Maltese cross 3 moves onto the drive pin 4, as indicated by a dashed ring in FIG. 3. As the control element 20 of the rectifier 2 continues to turn, the Maltese cross 3 is turned by the drive pin 4 into the position in FIG. 4, which is the position of the transition to the second turn of the rectifier 2. This rotation of the Maltese cross 3 is transferred through the pin 6 to the longitudinal identification protrusion 210, which also slightly turns. At this stage, the state of the transition of the rectifier 2 from the first to the second turn is indicated, which is shown in FIG. 4 and FIG. 7. This state is also indicated by the fact that the longitudinal identification protrusion 210 has slightly turned and is now situated obliquely with respect to the coding means 211, that is, in a kind of an intermediate position between the indication of the rectifier 2 in the first turn according to FIGS. 1 and 1*a* and the indication of the rectifier 2 in the second turn according to FIGS. 2 and 2*a*. With the control element 20 of the rectifier 2 continuing to turn towards the end of the second turn of the rectifier 2 the Maltese cross 3 is further turned by the drive pin 4, assuming the position with the drive pin indicated by a dashed ring in FIG. 5, by which means the longitudinal identification protrusion 210 completes its rotation, assuming the position shown in FIGS. 2 and 2*a*. Due to further rotation of the rectifier 2 the drive pin 4 indicated by the dashed ring in FIG. 5, moves out of the middle groove 31 of the Maltese cross 3, the control element 20 together with the Maltese cross 3 completes an entire circle in the direction of the arrow R and before the completion of this circuit, the third groove 32 of the Maltese cross 3 moves onto the drive pin 4, as is indicated by a full hatched ring in FIG. 5, whereby the drive pin 4 further prevents movement of the third groove 32, thereby blocking further rotation of the control element 20 of the rectifier 2, which is at this stage at the end of the second turn (at bottom dead center of the mechanism). This final state is shown in FIG. 5 and FIG. 8.

Figure 9:
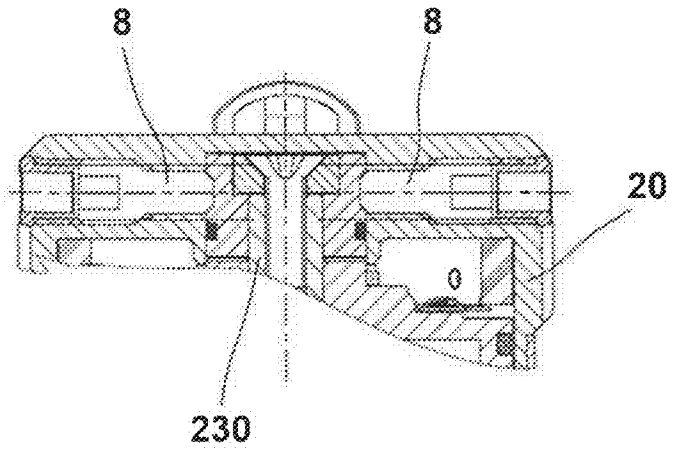
FIG. 9 is a cross-sectional view of the device according to the invention with locking bolts of the rectifier for setting the "zero stop" function.

At top dead center is also employed the "zero stop" function of the control element 20 of the rectifier 2, which is in the illustrated exemplary embodiment achieved by the mechanism described above. The "zero stop" function of the control element 20 of the rectifier 2 is based on the fact that a fixed starting point of the gun when zeroing the weapon is created, which allows the shooter to return the control 20 of the rectifier 2 always to the same initial (zero) position. The "zero stop" position must be set after the rectification and firing the weapon. A change in the setting of the "zero stop" position is in the solution according to the invention implemented by means of at least one locking bolt 8, see FIG. 9, which is transversely screwed in the control element 20 of the rectifier 2, and which in its locked position abuts with its face the sidewall of the rectifying screw 230, locking (in its locked position) or releasing (in its released position) the mutual rotational movement of the rectifying screw 230 and the control element 20 of the rectifier 2. Releasing the locking bolts 8 leads to releasing the connection of the rectifying screw 230 and the control element 20 of the rectifier 2, whereupon by rotation of the control element 20 of the rectifier 2 "to the stop", the initial (zero) position of the control element 20 of the rectifier 2 together with the Maltese cross 3 is set relative to the housing 220 along with the drive pin 4. In this position, the locking bolts 8 are tightened again, thereby securing this initial position fulfilling the "zero stop" function for the entire mechanism according to the invention.

In an unillustrated embodiment, the modified Maltese mechanism is provided with a plurality of grooves to accommodate the drive pin 4 the grooves being directed to each other, which enables to display a greater number of the turns of the rectifier 2 than the basic 2 turns, for which purpose is adapted the shape and design of the longitudinal identification protrusion 210 and the coding means 211, especially due to the fact that the longitudinal identification protrusion 210 must assume a greater number of positions slightly turned relative to the coding means 211 than the basic 2 positions described herein, and, moreover, it is essential that the greater number of the mutual positions of the longitudinal identification protrusion 210 and of the coding means 211 are reliably recognized by the user both visually and tactilely in conditions of reduced visibility or even in complete darkness.

Modifications and variations can be made to the embodiments illustrated or described herein without departing from the scope and spirit of the invention as set forth in the appended claims.

The invention claimed is:

1. An optical sight with a rectifier and device for indicating a turn of the rectifier, comprising:

a longitudinal body, wherein elements of the sight are mounted in the longitudinal body and operably coupled to the rectifier;

the rectifier comprising a manually rotatable control element and an indicator protruding from an upper surface of the rectifier, the indicator coupled to a mechanism configured to indicate a turn of the rectifier;

the indicator comprising a longitudinal identification protrusion having a length (L) in a direction along the upper surface of the rectifier, the longitudinal identification protrusion rotatable about an axis (OI) that is perpendicular to the length (L) and parallel to an axis (OP) of rotation of the control element, the longitudinal identification protrusion rotatable about the axis (OI) between a basic position and a turned position;

a coding device associated with the longitudinal identification protrusion and mounted on the upper surface of the rectifier above an upper surface of the longitudinal identification protrusion, wherein a rotated position of the longitudinal identification protrusion relative to the coding device provides to a user of the optical sight of turning of the rectifier; and and a zero stop mechanism configured with the control element of the rectifier.

2. The optical sight according to claim 1, wherein the coding device comprises a longitudinal strip disposed over the longitudinal identification protrusion.

3. The optical sight according to claim 1, wherein the longitudinal identification protrusion rotates 90° between extreme rotated end positions.

4. The optical sight according to claim 1, wherein the coding device comprises a shaped longitudinal strip disposed over the longitudinal identification protrusion and comprising a lower surface that follows the upper surface of the identification protrusion.

5. The optical sight according to claim 4, wherein the coding device comprises a width corresponding to a width of the longitudinal identification protrusion.

6. The optical sight according to claim 1, wherein the longitudinal identification protrusion comprises a color that is distinguishable from a color of the coding device.

7. The optical sight according to claim 1, wherein the longitudinal identification protrusion and the control element of the rectifier are coupled to a Maltese cross gear mechanism that transmits rotation of the control element to the longitudinal identification protrusion.

8. The optical sight according to claim 7, wherein the Maltese cross gear mechanism is rotatably mounted on a shaft having an axis of rotation identical to the axis of rotation (OI) of the longitudinal identification protrusion, the Maltese cross gear mechanism coupled to the longitudinal identification projection by a pin having one end eccentrically mounted in the Maltese cross gear mechanism and an opposite end eccentrically mounted in the longitudinal identification protrusion.

9. The optical sight according to claim 8, wherein the Maltese cross gear mechanism is connected to the control element of the rectifier and comprises three grooves arranged in relative angular relation, the grooves engaging with a drive pin mounted on a housing of the rectifier.

10. The optical sight according to claim 1, wherein the zero stop mechanism comprises a locking bolt mounted in the control element of the rectifier transversely to the axis (OP) of rotation of the control element, the locking bolt abutting a side wall of the rectifier in a locked position of the locking bolt.

* * * * *